United States Patent [19]

Ross

[11] 4,452,190

[45] Jun. 5, 1984

[54] COLD START FUEL/AIR MIXTURE SUPPLY DEVICE FOR SPARK IGNITION INTERNAL COMBUSTION ENGINES

[76] Inventor: Gray E. D. Ross, East Burne Farm, Bickington, Newton Abbot, S. Devon, England

[21] Appl. No.: 362,858

[22] Filed: Mar. 29, 1982

[30] Foreign Application Priority Data

Mar. 27, 1981 [GB] United Kingdom ..... 8109691

[51] Int. Cl.[3] ..... F02M 1/08

[52] U.S. Cl. ..... 123/179 G; 123/180 E; 123/438; 261/39 D

[58] Field of Search ..... 123/179 G, 437, 438, 123/180 R, 180 E; 261/39 D, 39 E

[56] References Cited

U.S. PATENT DOCUMENTS 3,917,760 11/1975 Swatman ..... 261/39 E
4,180,533 12/1979 Bonse ..... 123/179 G
4,192,277 3/1980 Ross ..... 123/179 G
4,222,236 9/1980 Hegedus et al. ..... 123/179 G
4,276,238 6/1981 Yoshikawa et al. ..... 123/179 G

FOREIGN PATENT DOCUMENTS 2809053 9/1978 Fed. Rep. of Germany ... 123/179 G

*Primary Examiner*—Andrew M. Dolinar

[57] ABSTRACT

A combined accelerator pump and cold start fuel/air mixture supply device has an automatic throttle valve in a mixture supply passage, a fuel control valve controlling flow of fuel drawn into the passage through an inlet upstream of the throttle valve, and an air valve upstream of the fuel inlet. A primary spring tends to seat the air valve. A light, secondary spring urges a plunger against the air valve to augment the load of the primary spring for a predetermined time interval after the engine begins to run under its own power. A valve in a pipe opens automatically at the end of the predetermined time interval to apply engine inlet manifold depression to the end of the plunger remote from the air valve and thereby to separate the plunger from the air valve so that only the primary spring acts on the air valve.

9 Claims, 8 Drawing Figures

COLD START FUEL/AIR MIXTURE SUPPLY DEVICE FOR SPARK IGNITION INTERNAL COMBUSTION ENGINES

This invention relates to air/fuel induction systems for spark ignition internal combustion engines which include a cold start system which is arranged so that an air/fuel mixture rich in fuel is supplied to the engine when the engine is started when it is cold, the mixture supplied being leaned off automatically as the engine warms up towards its normal running temperature at which there is no further need for fuel enrichment by operation of the cold start system, comprising a body; an air supply passage formed in the body; one end of the air supply passage being for connection to the inlet manifold of the engine so that air can be drawn through that passage by the action of engine suction when the passage is so connected; throttling means for throttling fluid flow through the air supply passage; a fuel control valve which is operable to allow fuel to be drawn from a fuel supply system into a location within the air supply passage upstream of said throttling means by the action of a depression which is established at said location, means for varying the effective cross-sectional area of a part of said air supply passage upstream of said location when the cold start system is in operation so as to control the depression that is established at said location when the cold start system is in operation, and yieldable biasing means for biasing said area varying means to minimize the effective cross-sectional area of said passage part, said yieldable biasing means acting in opposition to the effect upon said area varying means of the depression that is established at said location and that tends to increase the effective area of said passage part. Such an air/fuel induction system shall be referred to as "an air/fuel induction system of the kind referred to" in the remainder of this specification.

The cold start system of an air/fuel induction system of the kind referred to either is a separate device which is referred to in the remainder of this specification as "a cold start fuel/air mixture supply device of the kind referred to" and which is intended for use as part of an internal combustion engine installation for a motor vehicle which also includes a primary air/fuel metering system such as a carburetor which comprises a body in which an induction passage is formed and which has a driver-controllable throttle valve in that induction passage, the end of the induction passage downstream of the driver-controllable throttle valve being in conduit communication with the inlet manifold of the engine and said one end of the air supply passage being in conduit communication with the inlet manifold of the engine, or is a choke valve provided in the induction passage of such a carburetor upstream of the carburetor throat such as is described and illustrated in British Patent Specification No. 1,481,925.

The preferred form of throttling means of a cold start fuel/air mixture supply device of the kind referred to comprises a throttle valve which is arranged so that, in use of the device when said one end of the air supply passage is connected to the inlet manifold of a spark ignition internal combustion engine, it tends to be moved by engine suction into one position in which it co-operates with an adjacent part of the air supply passage to minimize or prevent the flow of air past it to the engine and which preferably comprises a profiled plug valve, biasing means which bias that throttle valve into an open position at least when the device is in use, and guide means which guide the throttle valve for rectilinear movement within the air supply passage between said two positions. The preferred form of cold start fuel/air mixture supply device of the kind referred to also includes a movable stop for limiting movement of the throttle valve towards said one position and thermostatic control means for controlling the position of said movable stop, said thermostatic control means being adapted to sense the temperature of the engine when the device is in use and to control the position of the movable stop accordingly so that the position of said stop is related to engine temperature and the permitted movement of the throttle valve is limited by the stop when the engine is cold and is increased as the engine warms up towards normal operating temperature whereby movement of the throttle valve to said one position is permitted.

The preferred form of area varying means of a cold start fuel/air mixture supply device of the kind referred to comprise an air valve and a co-operating valve seat positioned within the air supply passage upstream of said location, the yieldable biasing means tending to seat the air valve upon the valve seat. The preferred form of yieldable biasing means comprise a coil spring which acts directly upon the air valve.

One known form of cold start fuel/air mixture supply device of the kind referred to is arranged so that the biasing load exerted by the yieldable biasing means can be augmented by thrust exerted by a separate coil spring which acts to urge a plunger towards the area varying means, the plunger being subjected to manifold depression downstream of the driver controllable throttle valve by which it can be held spaced from the area varying means against the action of the separate coil spring when the manifold depression is sufficiently high. The biasing load exerted upon the area varying means by the yieldable biasing means is augmented by the load exerted by the separate coil spring on said area varying means via said plunger so that the depression in said location is higher than it would be if the biasing load was not so augmented. It follows that said yieldable biasing means may be identified as primary yieldable biasing means and said separate coil spring as supplementary yieldable biasing means.

The plunger and the separate coil spring were provided in order to enable the cold start fuel/air mixture supply device of the kind referred to to respond to changes in engine loading and effect an appropriate modification in the composition of the mixture drawn from it by that engine. It was thought that the plunger would always be held spaced from the area varying means for engine idling conditions, but it has been found that, for very low temperatures (say temperatures of the order of −30° C.), manifold depression is not sufficient to compress the separate coil spring that is required to provide the desired extra thrust for acceleration conditions. In view of this problem I have preferred to use a cold start fuel/air mixture supply device of the kind referred to in conjunction with a fuel pump of the kind which is known as an acceleration pump since such a combination can respond to changes in engine loading and effect an appropriate modification in the composition of the air/fuel mixture drawn from it by that engine even when the cold start fuel air mixture supply device of the kind referred to does not incorporate supplementary yieldable biasing means for augmenting the thrust exerted by primary yieldable biasing means upon the area varying means. A combination of an acceleration pump and a cold start fuel/air mixture supply device of the kind referred to is described and claimed in the published United Kingdom Patent Application No. 2016602 A.

It is desirable that, for a period which begins when the engine begins to run under its own power and which extends for a duration which varies from engine to engine but which is usually measured in seconds, fuel should be supplied to the engine at a volume rate of flow which exceeds that necessary merely to support combustion within the cylinders of the engine. The extra fuel is needed to wet the surfaces of the combustion chamber of each cylinder of the engine. The amount of extra fuel for that purpose diminishes as the temperature in the combustion chamber increases. British Patent Specification Nos. 1463176 and 1537344 disclose the provision of elaborate arrangements in an engine fuel supply system which are intended to be effective during this period so that a richer fuel/air mixture is supplied to the engine during this period than after the period is concluded. The published British Patent Application No. 2020752A describes and claims a cold start fuel/air mixture supply device of the kind referred to which is fitted with means adapted to modify the operation of the throttle valve and/or the fuel control valve of the device during this period so that the desired amount of extra fuel is supplied. The mechanism required to effect this proposal has been found to be undesirably expensive for volume production. Accordingly it is an object of this invention to provide an alternative solution to this problem which is less expensive and more appropriate for volume production.

According to one aspect of this invention there is provided a cold start fuel/air mixture supply device of the kind referred to in combination with a fuel pump which is an acceleration pump, in which the yieldable biasing means comprise primary yieldable biasing means and the device includes supplementary yieldable biasing means operable to augment the biasing load exerted upon the said area varying means by said primary yieldable biasing means in opposition to the effect upon said area varying means of the depression that is established at said location, and counteracting means operable to render said supplementary yieldable biasing means inoperative, wherein further means are provided which are adapted, when the combination is in use, to render the counteracting means inoperable for a predetermined period after the engine begins to run under its own power so that the thrust exerted on said area varying means by said primary yieldable biasing means is augmented by a thrust exerted by said supplementary yieldable biasing means for said predetermined period, said counteracting means being operable once said predetermined time interval has elapsed and said engine continues to run under its own power so that only said primary yieldable biasing means exert a load on said area varying means which opposes the effect thereon of the depression that is established at said location when said counteracting means are operated to render said supplementary yieldable biasing means inoperative.

Preferably said supplementary yieldable biasing means comprise a light coil spring; said counteracting means comprise a plunger which is urged towards said area varying means by said light coil spring and by which the thrust exerted by said light coil spring is applied to said area varying means when it abuts said area varying means, and conduit means by which a depression established in the engine inlet manifold when the engine is running under its own power is applied to the plunger in opposition to the action thereon of said light coil spring so that the plunger is separated from said area varying means when the load on the plunger due to the action of that depression on the plunger exceeds that due to the light coil spring on the plunger, and said further means comprise a shut-off valve in said conduit means and a control mechanism for said shut-off valve, said control mechanism being arranged so that said valve is closed to isolate said plunger from the engine inlet manifold for said predetermined time interval, and also being adapted to cause said shut-off valve to be opened at the end of said predetermined time interval and to hold those valves open until the engine stops running under its own power.

Conveniently said control mechanism comprises an electronic control mechanism. It may include a positive temperature co-efficient element and a valve actuating element which is located adjacent to the positive temperature co-efficient element so that it is heated by heat emitted by the positive temperature co-efficient element which is adapted to be subjected to an electrical output when the engine is running under its own power. The valve actuating element may be a bi-metallic element which carries the closure member of the shut-off valve and which is adapted to seat the closure member to close the conduit when it is cold. Preferably the positive temperature co-efficient element is sandwiched between one end of the bi-metallic element and an end of a radiator plate which is spaced from the bi-metallic element, the radiator plate and the bi-metallic element extending in the same direction from the positive temperature co-efficient element whereby the bi-metallic element is heated by conduction of heat to it from the positive temperature co-efficient element and by radiation of heat from the radiator plate which in turn is heated by conduction of heat to it from the positive temperature co-efficient element. The time required for the bi-metallic element to be heated sufficiently to open the shut-off valve is reduced by the provision of the radiator plate as compared to the time that would be required if it were heated solely by conduction of heat from the positive temperature co-efficient element.

Various attempts have been made for the reasons discussed above to use a mechanism including a positive temperature co-efficient element in a spark ignition internal combustion engine air/fuel induction system to delay, for a period after the engine first fires, the initial leaning off of the fuel rich air/fuel mixture that is normally made available while the engine is being cranked, by delaying the opening of the usual air valve or choke valve that is provided in the air supply passage upstream of the location into which fuel is drawn. These attempts have not been satisfactory because the minimum delay periods have been too long.

Another object of this invention is to provide a suitable delay mechanism including a positive temperature co-efficient element which has a shorter time delay period.

According to another aspect of this invention there is provided an air/fuel induction system for spark ignition internal combustion engines including a cold start system which is arranged so that an air/fuel mixture rich in fuel is supplied to the engine when the engine is started when it is cold, the mixture supplied being leaned off automatically as the engine warms up towards its normal running temperature at which there is no further need for fuel enrichment by operation of the cold start system, comprising a body; an air supply passage formed in the body; one end of the air supply passage being for connection to the inlet manifold of the engine so that air can be drawn through that passage by the action of engine suction when the passage is so connected; throttling means for throttling fluid flow through the air supply passage; a fuel control valve which is operable to allow fuel to be drawn from a fuel supply system into a location within the air supply passage upstream of said throttling means by the action of a depression which is established at said location, means for varying the effective cross-sectional area of a part of said air supply passage upstream of said location when the cold start system is in operation so as to control the depression that is established at said location when the cold start system is in operation, and yieldable biasing means for biasing said area varying means to minimize the effective cross-sectional area of said passage part, said yieldable biasing means acting in opposition to the effect upon said area varying means of the depression that is established at said location and that tends to increase the effective area of said passage part, in which the yieldable biasing means comprise primary yieldable biasing means and the cold start system includes supplementary yieldable biasing means operable to augment the biassing load exerted upon the said area varying means by said primary yieldable biassing means in opposition to the effect upon said area varying means of the depression that is established at said location, and counteracting means operable to render said supplementary yieldable biasing means inoperative, wherein further means are provided which are adapted, when the cold start system is in use, to render the counteracting means inoperable for a predetermined time interval after the engine begins to run under its own power so that the thrust exerted on said area varying means by said primary yieldable biasing means is augmented by a thrust exerted by said supplementary yieldable biasing means for said predetermined period, said counteracting means being operable once said predetermined time interval has elapsed and said engine continues to run under its own power so that only said primary yieldable biasing means exert a load on said area varying means which opposes the effect thereon of the depression that is established at said location when said counteracting means are operated to render said supplementary yieldable biasing means inoperative, wherein said further means comprise a bi-metallic element having one condition in which it is operable to render said counteracting means inoperative and another condition in which it allows operation of said counteracting means, a positive temperature co-efficient element which is adapted to be subjected to an electrical output when the engine is running under its own power and which is located in heat conducting relationship with the bi-metallic element, and a radiator plate which is located in adjacent spaced relationship with the bi-metallic element and in heat conducting relationship with the positive temperature co-efficient element whereby the bi-metallic element is changed from said one condition to said other condition by being heated by conduction of heat to it from the positive temperature co-efficient element and by radiation of heat from the radiator plate which in turn is heated by conduction of heat to it from the positive temperature co-efficient element.

Preferably the positive temperature co-efficient element is sandwiched between one end of the bi-metallic element and an end of the radiator plate. This has the advantage that heat emitted from both sides of the positive temperature co-efficient element is used to heat the bi-metallic element with the consequent advantages that the amount of useful heat is greater than if the heat output from only one side was used so that the time for changing the state of the bi-metallic element from said one state to the other state is reduced.

Two embodiments of this invention will be described now by way of example with reference to the accompanying drawings of which:

Figure 1:
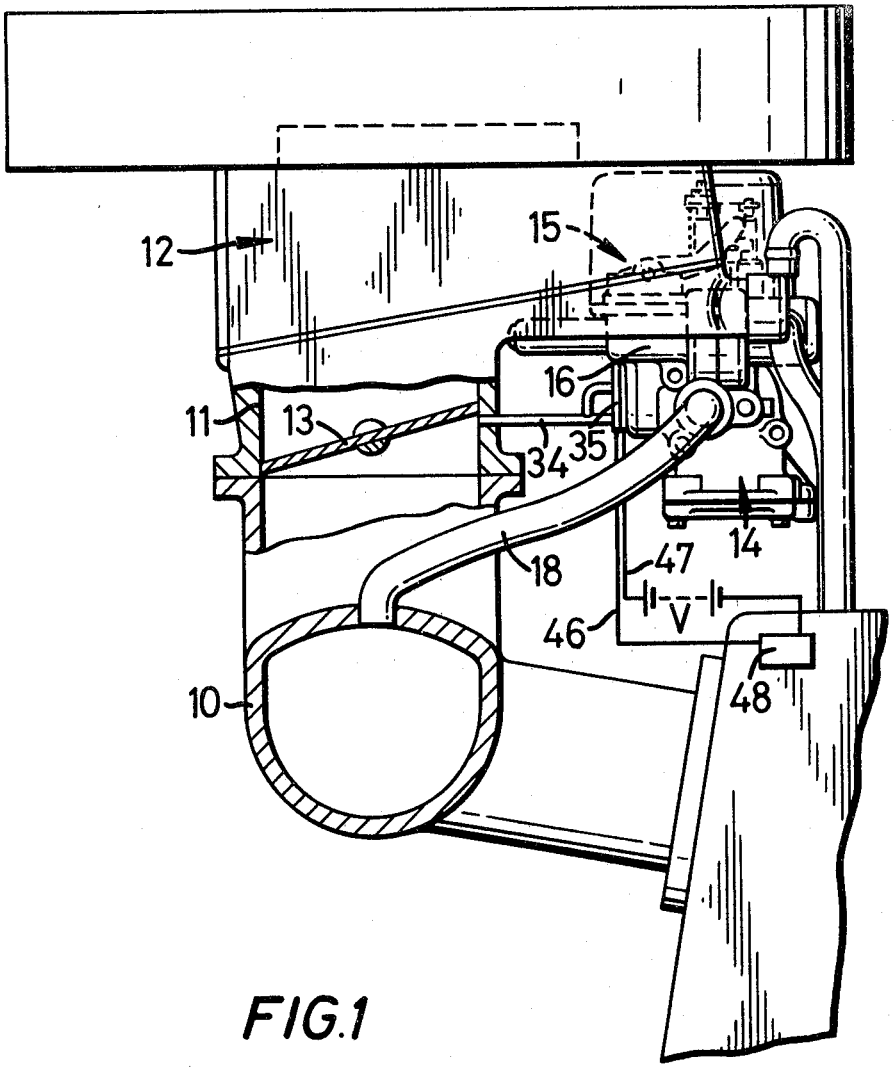
FIG. 1 is a partly sectioned elevation of an air/fuel induction system for a spark ignition internal combustion engine, the system including a carburetor, a cold start fuel/air mixture supply device, and a fuel pump.

FIG. 1 illustrates a spark ignition internal combustion engine installation for a motor vehicle which includes an air/fuel induction system which comprises an engine inlet manifold 10 to which the induction passage 11 of a carburetor 12 is connected. A driver-operable throttle valve of the carburetor is indicated at 13.

The air/fuel induction system also includes a fuel pump 14, which is an accelerator pump, and a fully-automatic cold start fuel/air mixture supply device 15 which are housed in a single body 16 which is mounted on the body of carburetor 12.

Most of the air/fuel induction system and more particularly of the fuel pump 14 and the fully automatic cold start fuel/air mixture supply device 15 are substantially as described and illustrated in the published specification of the U.K. Patent Application No. 2016602A. The improvement that forms the subject of this application is concerned with the air valve arrangement incorporated in the cold start device 15. The detailed construction and operation of the fuel pump 14, the rectilinearly removable throttle valve and fuel metering needle which are joined to one another, the thermostatic control mechanism by which the movement of those two joined valves is controlled in accordance with the temperature of the engine and suction exerted thereon by operation of the engine, and the single body 16 in which the fuel pump 14 and the fully-automatic cold start fuel air mixture supply device 15 are housed, are substantially as described and illustrated in the published specification of the U.K. Patent Application 2016602A. Accordingly I am not including a detailed description here of those parts that are substantially identical to corresponding parts of the device described and illustrated in Specification No. 2016602A, which is not necessary for a proper description of the invention that forms the subject of this application.

Figure 2:
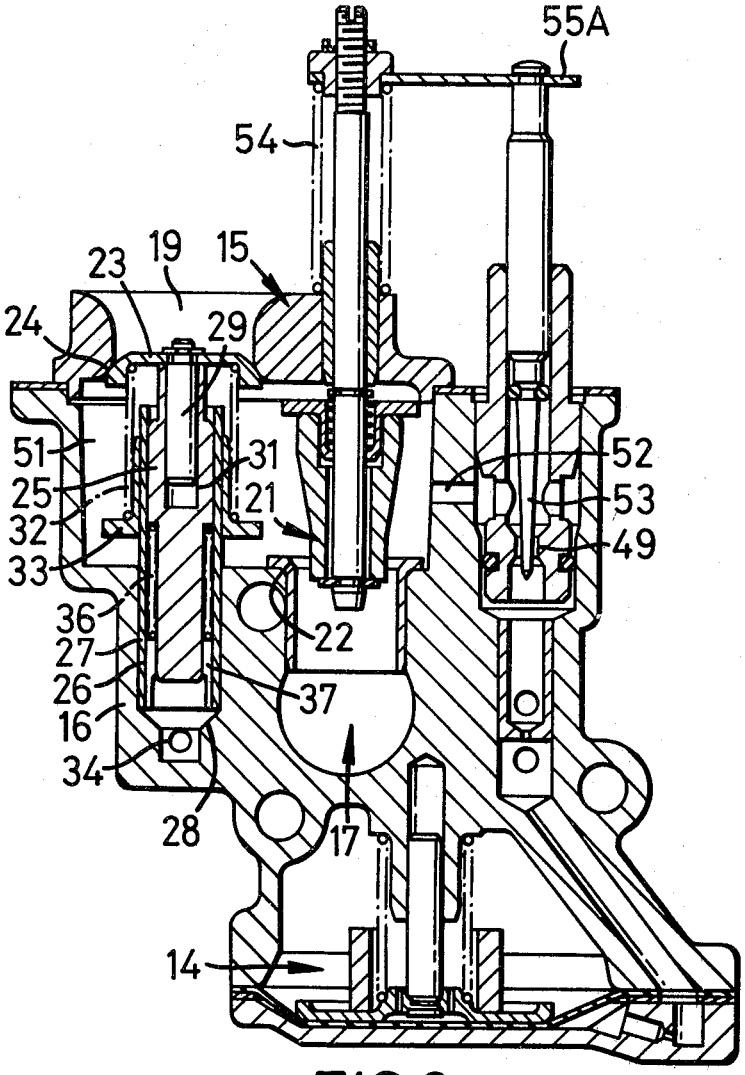
FIG. 2 is a section through the cold start fuel/air mixture supply device and the fuel pump of the system shown in FIG. 1, with its cover removed.
Figure 3:
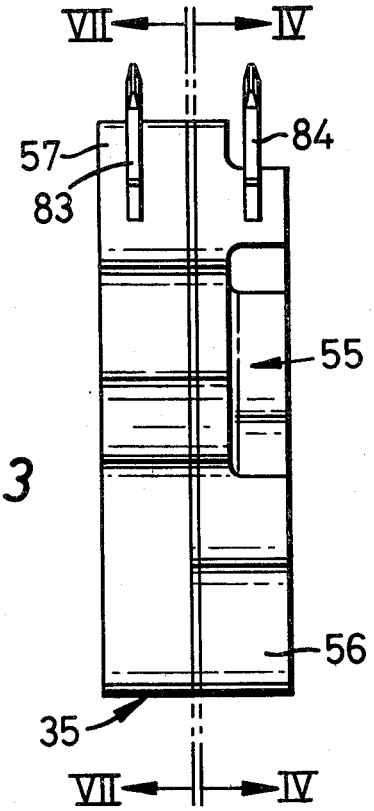
FIG. 3 is an elevation of a detail of the system shown in FIG. 1 drawn to a larger scale than in FIG. 1.
Figure 5:
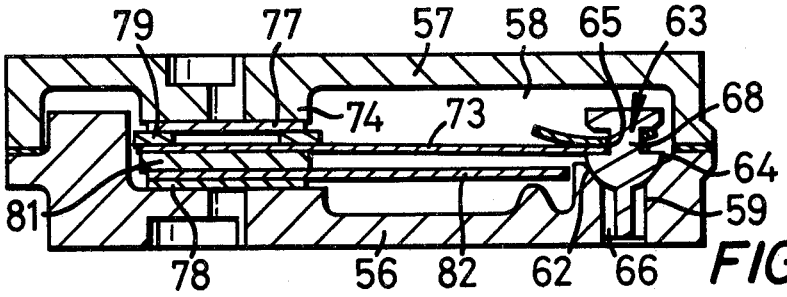
FIG. 5 is a section on the line V—V in FIG. 4.
Figure 6:
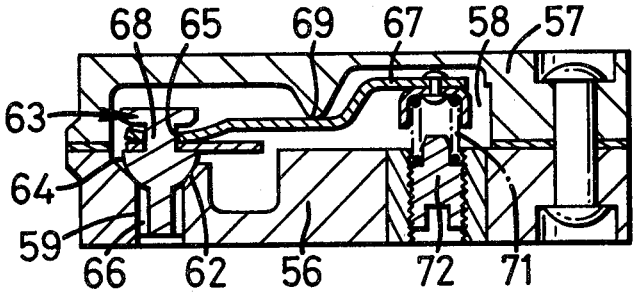
FIG. 6 is a section on the line VI—VI in FIG. 4.
Figure 4:
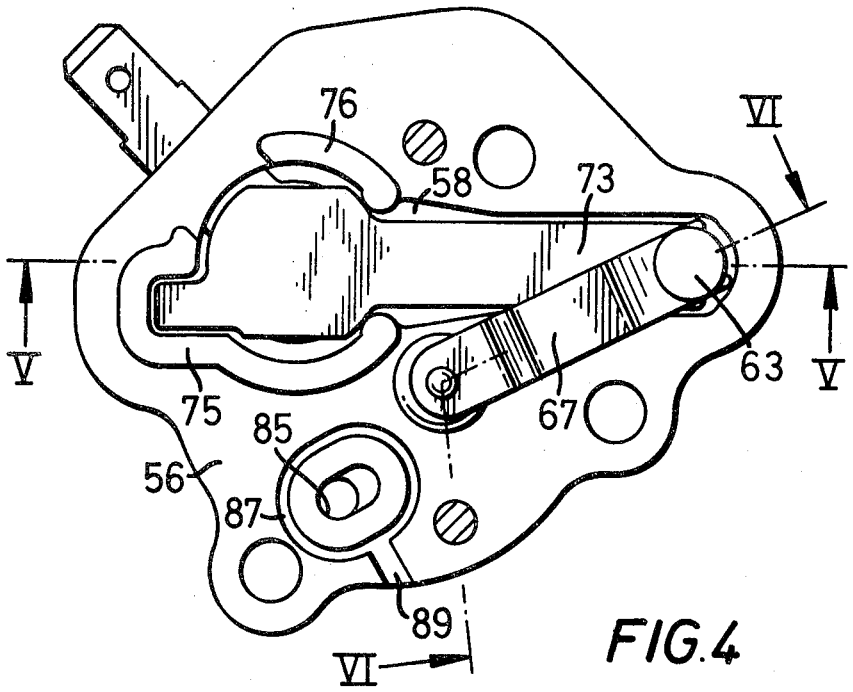
FIG. 4 is a view in the direction of the arrows IV of the valve assembly shown in FIG. 3 with a part of its casing removed.
Figure 7:
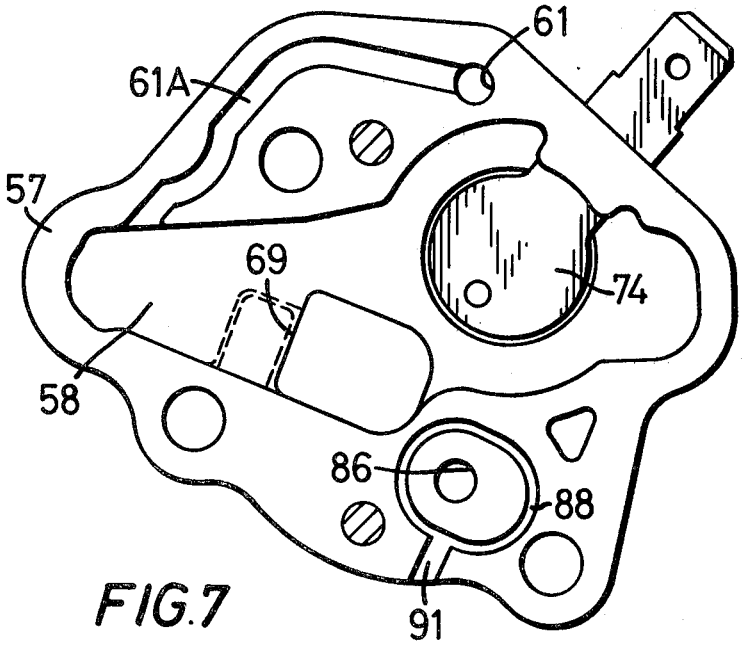
FIG. 7 is a view in the direction of the arrows VII of the part of the valve assembly shown in FIG. 3 that is removed in FIG. 4.

FIG. 2 shows that the cold start device 15 comprises a through passage 17 formed in the body 16. The through passage 17 is an air supply passage. Its downstream end is connected to the inlet manifold 10 via a pipe 18 (see FIG. 1).

FIG. 2 also shows that the upstream end of the air supply passage 17 comprises an aperture 19. The throttle valve is a profiled plug valve 21 which co-operates with an orifice 22 which is formed in the air supply passage 17, in order to throttle fluid flow through that orifice 22. The plug valve 21 is guided for rectilinear movement.

The air valve 23, which is rectilinearly movable, co-operates with a valve seat 24 to close the aperture 19.

A plunger 25 has a central portion, which is engaged for sliding movement within the bore 26 of a tubular insert 27, and reduced diameter end portions. The tubular insert 27 has one end spigotted into a blind bore 28 which is formed in the body 16. The remainder of the tubular insert 27 projects from the bore 28 into the air supply passage 17.

The air valve 23 has a coaxial cylindrical guide stem 29 which is engaged for sliding movement within a closed ended axial bore 31 which is formed in the plunger 25. A coil spring 32 reacts against the flange of a flanged tubular abutment member 33, which is mounted slidably upon that part of the insert 27 that projects into the air supply passage 17, and biasses the air valve 23 to seat on its seat 24. The abutment member 33 is located by abutment with the end of an adjuster screw (not shown) which is screwed into the body 16.

The closed inner end of the blind bore 28 is connected to the induction passage 11 of the carburetor 12 just downstream of the driver-operable throttle valve 13 by a short pipe 34 and communication between the blind bore 28 and the induction passage 11 is controlled by a valve arrangement 35 which is described below.

A light spring 36 reacts against a spider 37, which is fixed in the bore of the tubular insert 27, and urges the plunger 25 towards the air valve 23. The British Patent specification No. 1581722 includes a full description of the detailed construction and arrangement of the air valve 23, the plunger 25, the guide stem 29 and the coil springs 32 and 36, but it should be understood that a spring which exerts a substantially lower load than does the corresponding spring of the arrangement described in the Specification No. 1581722 is used as the light spring 36 so that it will yield so that the plunger 25 is spaced from the air valve 23 whenever manifold depression applied to it exceeds a certain minimum value determined by the characteristics of the spring 36.

FIGS. 3 to 7 show details of the valve arrangement 35 which comprises a casing 55 which is mounted on the body 16. The casing is formed in two parts 56 and 57 which are riveted together face to face, the adjacent faces being recessed so that the two parts co-operate together to form a chamber 58. A port 59 (see FIGS. 5 and 6) is formed in the casing part 56 which abuts the body 16. The inner end of the port 59 communicates with the chamber 58 and the outer end of the port 59 communicates with the closed inner end of the blind bore 28 via the portion of the short pipe 34 that extends through the body 16. Another port 61 is formed in the other casing part 57 (see FIG. 7) to one side of the recess therein that forms the chamber 58. The port 61 communicates with the chamber 58 via a channel 61A which is formed in the face of the casing part 57 that mates with the adjacent face of the casing part 56.

The inner end of the port 59 is formed as a conical valve seat 62. A valve 63 is located within the chamber 58 and has a part spherical surface portion 64 which co-operates with the valve seat 62 and which is between a circumferential groove 65 and a fluted spigot portion 66 of the valve 63. The fluted spigot portion 66 is a sliding fit in the port 59 so that its flutes provide communication between the chamber 58 and the blind bore 28 when the part spherical surface portion 64 is unseated. The blind bore 28 is shut off from the chamber 58 when the part spherical surface portion 64 is seated in the valve seat 62.

A rocker beam 67 within the chamber 58 is forked at one end, the waisted portion 68 of the valve 63 that is surrounded by the circumferential groove 65 is received in between the arms of the fork which project into the circumferential groove 65. The beam 67 pivots on a knife edge 69 which is formed by a projection from the base of the recess that is formed in the casing part 57, and is urged to seat the valve 63 in its seat 62 by a spring 71 which acts on it at its other end. The spring 71 reacts against an adjuster screw 72 which is fitted into a tapped hole formed in the casing part 56.

A bi-metallic strip 73 within the chamber 58 is forked at one end. The waisted portion 68 of the valve 63 is received between the arms of the fork which also project into the circumferential groove 65. The other end of the bi-metallic strip 73 is part of a stack of elements which is sandwiched between a portion of the base of the recess formed in the casing part 56 and a projection 74 which is formed in the base of the recessed portion of the other casing part 57. Projecting portions 75 and 76 of the casing part 56 extend around the stack and locate its elements against lateral displacement.

The other elements of the stack are two contact plates 77 and 78, a wavey washer 79, a positive temperature co-efficient element 81 and a radiator plate 82. Each contact plate 77, 78 is electrically connected to a respective one of two terminal pins 83 and 84 which are embedded in and project outwards from a respective one of the two casing parts 56 and 57. The contact plate 77 abuts the projection 74. The positive temperature co-efficient element 81 is sandwiched between the bi-metallic strip 73 and the radiator plate 82. The wavey washer 79 reacts against the contact plate 77 and acts upon the bi-metallic strip 73 to urge it against the positive temperature co-efficient element 81, the positive temperature co-efficient element 81 against the radiator plate 82 and the radiator plate 82 against the other contact plate 78 which abuts the casing part 56. The radiator plate 82 projects from the stack into the chamber 58 alongside the bi-metallic strip 73 but is spaced from both the bi-metallic strip 73 and the casing part 56.

Two leads 46 and 47 extend each from a respective one of the terminal pins 83 and 84 and are each connected to a respective terminal of a suitable source V of electrical potential, such as the accumulator of the motor vehicle as is shown in FIG. 1. A normally open switch 48 is connected into the lead 46 and is adapted to be actuated to make its contacts either by engine oil pressure as that oil pressure rises or by the depression in the inlet manifold as that depression increases as the engine begins to run under its own power or by a pulse from the engine ignition system.

A fuel passage, including a fuel metering orifice 49, communicates with a location 51 in the air supply passage 17 downstream of the aperture 19 and upstream of the throttle valve orifice 22, via a fuel discharge orifice 52. The fuel passage also communicates with the fuel chamber of the carburetor 12 via aligned holes 85 and 86 formed each in a respective one of the two casing parts 56 and 57 of the valve arrangement 35. The adjacent ends of the two holes 85 and 86 are both surrounded by a groove 87, 88 in the face of the respective casing part 56, 57, that groove 87, 88 being vented by a vent groove 89, 91. The rectilinearly movable fuel metering needle 53, that is joined to the plug valve 21, co-operates with the fuel metering orifice 49 in the usual way to meter fuel flow through that orifice. A coil spring 54 urges the plug valve 21 and the fuel metering needle 53 into the respective positions in which the effective cross-sectional areas of the orifices 22 and 49 with which they co-operate are at their greatest.

Movable stops are provided, as described and illustrated in the published specification of the U.K. Patent Application No. 2016602A, for limiting movement of the throttle valve 21 and the fuel metering needle 53 in the direction to reduce the effective cross-sectional area of the orifices 22 and 49 with which they co-operate and thermostatic control means adapted to respond to the temperature of the engine are also provided for controlling the position of the movable stops. The movable stops co-operate with the arm 55A by which the plug valve 21 and the fuel metering needle 53 are joined.

Operation of the combined cold start fuel/air mixture supply device 15 and accelerator pump 14 is basically as is described in the specification of the published U.K. Patent Application No. 2016602A but with the following exceptions.

When the engine is cold and not running and when it is cranked for starting, the contacts of the switch 48 are open. Also the bi-metallic strip 73 is cold. Hence the valve 63 is seated by the combination of the resilient load exerted upon it by the bi-metallic strip 73 and the loading of the coil spring 71 that is applied to it by the rocker beam 67. Consequently the space formed between the closed inner end of the blind bore 28 and the adjacent end of the plunger 25 is isolated from the engine inlet manifold 10. Hence the plunger 25 is urged by the light coil spring 36 into abutment with the air valve 23 and the air valve 23 is seated by the load exerted on it by the primary spring 32 augmented by the load exerted by the supplementary spring, that is the light coil spring 36, via the plunger 25.

When the cold engine begins to run under its own power, the suction exerted by that engine increases and the contacts of the switch 48 are made. Unlike the arrangement described in the specification of the published U.K. Patent Application No. 2016602A, the only load acting to unseat the air valve 23 is the loading on the air valve 23 due to the depression established in that part of the air supply passage between the orifices 19 and 22. For as long as the valve 63 is held seated by the combined action of the bi-metallic strip 73 and the spring 71, that depression must overcome the loading exerted by the two coil springs 32 and 36 in order to unseat the air valve 23. Consequently the effective area of the opening afforded by the unseated air valve 23 for air flow through the aperture 19 is less than it would be if the biasing load acting on the air valve 23 was provided by the primary biasing spring 32 only. It follows that the depression established in that part of the air supply passage between the aperture 19 and the throttle valve 22 is higher than it would be if the biasing load acting on the air valve 23 was provided by the primary spring 32 only. Hence the fuel demand signal by which fuel is drawn through the fuel passage into the air supply passage 17 is higher with the result that the mixture drawn from the air supply passage 17 by the engine is richer.

Closure of the contacts of the switch 48 as the engine began to run under its own power completed the circuit by which the positive temperature co-efficient element 81 is connected to the source of electrical potential V. Hence the positive temperature co-efficient element 81 began to emit heat when the engine began to run under its own power. That heat heated both the bi-metallic element 73 and the radiator plate 82 by conduction. The bi-metallic element 73 was also heated by radiation, the heat absorbed by the radiator plate 82 by conduction from the positive temperature co-efficient element 81 being conducted along its length and emitted from it along its length to heat the bi-metallic element 73 by radiation. At the end of a predetermined time interval after the engine began to run under its own power, the bi-metallic element 73 had absorbed sufficient heat for it to deform and allow the unseating of the valve 63 necessary for sufficient communication between the engine inlet manifold 10 and the space formed in the blind bore 28 between its closed inner end and the adjacent end face of the plunger 25 to be established via the short tube 34. That time period is considerably shorter than it would have been if the radiator plate 82 had not been fitted and the bi-metallic element 73 heated only by conduction from the positive temperature coefficient element. Since the supplementary coil spring 36 is a light spring, it will yield so that the plunger 25 is drawn by that engine suction away from the air valve 23. The plunger is held in abutment with a suitable stop (not shown) by suction exerted by the engine and the valve 63 remains unseated and the position of the air valve 23 relative to its seat 24 is determined solely by the opposing forces exerted on it of the primary coil spring 32 on the one hand and the depression established in that part of the air supply passage between the aperture 19 and the throttle valve orifice 22 on the other hand. Consequently the fuel demand signal is not as high as it would have been if the position of the air valve 23 was determined by the full load of both springs 32 and 36 so that the mixture drawn from the engine is not as rich as it would have been in such circumstances. In most engine installations which include a cold start fuel/air mixture supply device in which this invention is embodied, the plunger 25 is held displaced from the air valve 23 and in abutment with its associated stop for as long as the engine continues to run under its own power but, in certain applications, particularly when the carburetor 12 is a fixed choke carburetor, it is possible for the supplementary spring 36 to exert some load on the air valve 23 through the plunger 25 under some driving conditions.

Fuel is not drawn from that part of the fuel passage formed by the holes 85 and 86 into the chamber 58 by suction in that chamber 58 because the junction between those holes 85 and 86 is surrounded by a passage which is vented to atmosphere.

The remainder of the operation of the cold start fuel/air mixture supply device 15 and the fuel pump 14 will be apparent from the published specification of the United Kingdom Patent Application 2016602A.

Figure 8:
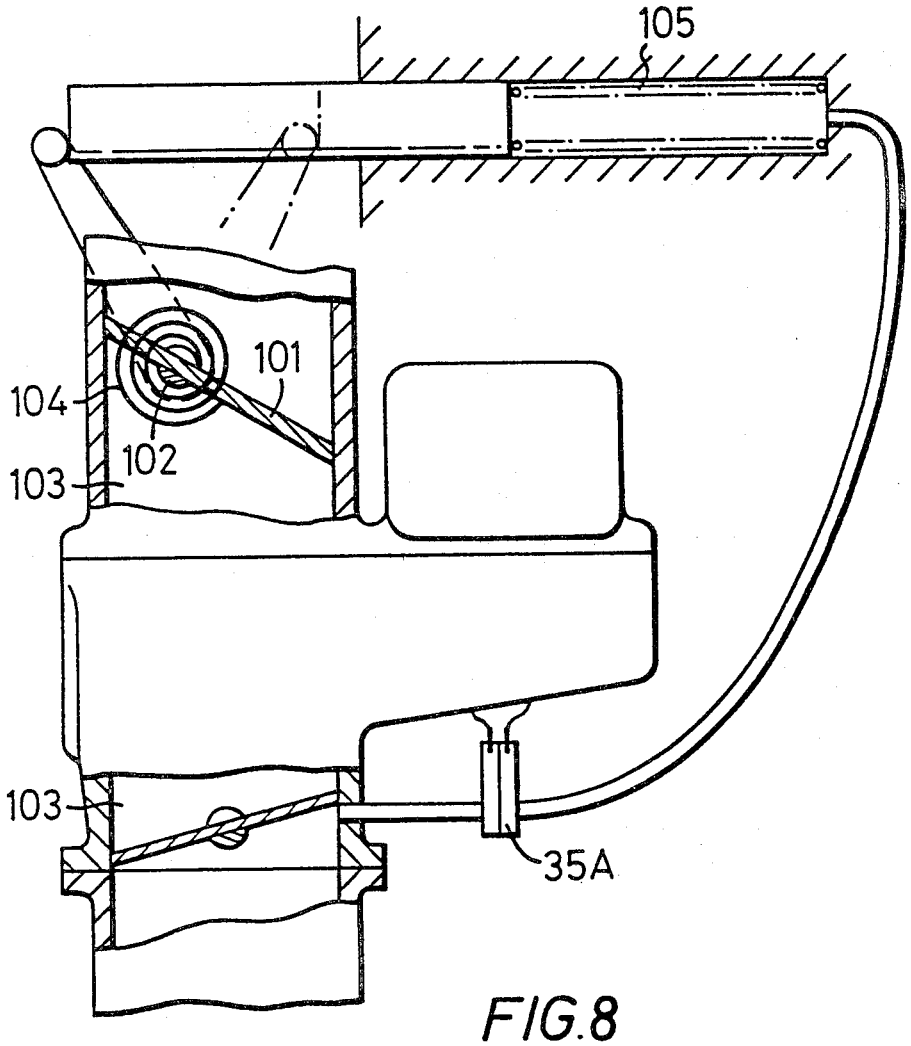
FIG. 8 is a diagram illustrating application of this invention to a carburetor having a cold start system which comprises an automatic choke valve.

This invention can be applied to carburetors having cold start systems which comprise an automatic choke valve as illustrated diagrammatically in FIG. 8. Such a choke valve conveniently comprises a flap 101 mounted on an offset spindle 102 which extends across the carburetor induction passage 103 upstream of the throat (not shown) and the fuel supply orifices (not shown). The spindle 102 is biased by a primary spring 104 into the position in which the flap 101 extends across and closes the induction passage 103. A thermosensitive device (not shown), such as a bi-metallic coil which is exposed to the temperature of the engine, say by being surrounded by a water jacket which is part of the engine cooling water system, is connected to the spindle 102 in such a way that it acts to oppose opening movement of the choke flap 101 due to the action thereon of a depression established in the carburetor induction passage 103 by operation of the engine, the force exerted by the thermosensitive device in opposition to such opening of the choke flap 101 being progressively reduced as the engine temperature increases. In order to apply the present invention to such an automatic choke flap cold start system, a supplementary spring 105 can be provided to augment the biasing load exerted by the primary spring 104 and a mechanism 35A including a valve, similar to that described above with reference to FIGS. 3 to 7 of the accompanying drawings can be arranged to effect removal of the load of the supplementary spring from the spindle once the time interval after first firing of the engine to unseat the valve member 63 has elapsed.

I claim:

1. A cold start fuel/air mixture supply device for supplying a fuel/air mixture to an inlet manifold of an internal combustion engine in combination with a fuel pump which is an accelerator pump, said device comprising a body; an air supply passage formed in the body; one end of the air supply passage being for connection to the inlet manifold of the engine so that air can be drawn through that passage by the action of engine suction when the device is fitted to the engine; throttling means for throttling fluid flow through the air supply passage; a fuel control valve which is operable to allow fuel to be drawn from a fuel supply system into a location within the air supply passage upstream of said throttling means by the action of a depression which is established at said location, means for varying the effective cross-sectional area of a part of said air supply passage upstream of said location when the device is in use so as to control the depression that is established at said location when the device is in use, and yieldable biasing means for biasing said area varying means to minimize the effective cross-sectional area of said passage part, said yieldable biasing means acting in opposition to the effect upon said area varying means of the depression that is established at said location and that tends to increase the effective area of said passage part, in which the yieldable biasing means comprise primary yieldable biasing means and the device includes supplementary yieldable biasing means operable to augment the biasing load exerted upon said area varying means by said primary yieldable biasing means in opposition to the effect upon said area varying means of the depression that is established at said location, and counteracting means operable to render said supplementary yieldable biasing means inoperative, wherein further means are provided which are adapted, when the combination is in use, to render the counteracting means inoperable for a predetermined time interval after the engine begins to run under its own power so that the thrust exerted on said area varying means by said primary yieldable biasing means is augmented by a thrust exerted by said supplementary yieldable biasing means for said predetermined period, said counteracting means being operable once said predetermined time interval has elapsed and said engine continues to run under its own power so that only said primary yieldable biasing means exert a load on said area varying means which opposes the effect thereon of the depressing that is established at said location when said counteracting means are operated to render said supplementary yieldable biasing means inoperative.

2. A combination according to claim 1, wherein said supplementary yieldable biasing means comprise a light coil spring; said counteracting means comprise a plunger which is urged towards said area varying means by said light coil spring and by which the thrust exerted by said light coil spring is applied to said area varying means when it abuts said area varying means, and conduit means by which a depression established in the engine inlet manifold when the engine is running under its own power is applied to the plunger in opposition to the action thereon of said light coil spring so that the plunger is separated from said area varying means when the load on the plunger due to the action of that depression on the plunger exceeds that due to the light coil spring on the plunger, and said further means comprise a shut-off valve in said conduit means and a control mechanism for said shut-off valve, said control mechanism being arranged so that said valve is closed to isolate said plunger from the engine inlet manifold for said predetermined time interval, and also being adapted to cause said shut-off valve to be opened at the end of said predetermined time interval and to hold that valve open until the engine stops running under its own power.

3. A combination according to claim 2, wherein said control mechanism comprises an electronic control mechanism.

4. A combination according to claim 3, wherein the electronic control mechanism includes a positive temperature co-efficient element and a valve actuating element which is located adjacent to the positive temperature co-efficient element so that it is heated by heat emitted by the positive temperature co-efficient element which is adapted to be subjected to an electrical output when the engine is running under its own power.

5. A combination according to claim 4, wherein the valve actuating element is a bi-metallic element which carries the closure member of the shut-off valve and which is adapted to seat the closure member to close the conduit when it is cold.

6. A combination according to claim 5, wherein the positive temperature co-efficient element is sandwiched between one end of the bi-metallic element and an end of a radiator plate which is spaced from the bi-metallic element, the radiator plate and the bi-metallic element extending in the same direction from the positive temperature co-efficient element whereby the bi-metallic element is heated by conduction of heat to it from the positive temperature co-efficient element and by radiation of heat from the radiator plate which in turn is heated by conduction of heat to it from the positive temperature co-efficient element.

7. An air/fuel induction system for spark ignition internal combustion engines including a cold start system which is arranged so that an air/fuel mixture rich in fuel is supplied to an inlet manifold of the engine when the engine is started when it is cold, the mixture supplied being leaned off automatically as the engine warms up towards its normal running temperature at which there is no further need for fuel enrichment by operation of the cold start system, comprising a body; an air supply passage formed in the body; one end of the air supply passage being for connection to the inlet manifold of the engine so that air can be drawn through that passage by the action of engine suction when the passage is so connected; throttling means for throttling fluid flow through the air supply passage; a fuel control valve which is operable to allow fuel to be drawn from a fuel supply system into a location within the air supply passage upstream of said throttling means by the action of a depression which is established at said location, means for varying the effective cross-sectional area of a part of said air supply passage upstream of said location when the cold start system is in operation so as to control the depression that is established at said location when the cold start system is in operation, and yieldable biasing means for biasing said area varying means to minimize the effective cross-sectional area of said passage part, said yieldable biasing means acting in opposition to the effect upon said area varying means of the depression that is established at said location and that tends to increase the effective area of said passage part, in which the yieldable biasing means comprise primary yieldable biasing means and the cold start sytem includes supplementary yieldable biasing means operable to augment the biasing load exerted upon said area varying means by said primary yieldable biasing means in opposition to the effect upon said area varying means of the depression that is established at said location, and counteracting means operable to render said supplementary yieldable biasing means inoperative, wherein further means are provided which are adapted, when the cold start system is in use, to render the counteracting means inoperable for a predetermined time interval after the engine begins to run under its own power so that the thrust exerted on said area varying means by said primary yieldable biasing means is augmented by a thrust exerted by said supplementary yielding biasing means for said predetermined period, said counteracting means being operable once said predetermined time interval has elapsed and said engine continues to run under its own power so that only said primary yieldable biasing means exert a load on said area varying means which opposes the effect thereon of the depression that is established at said location when said counteracting means are operated to render said supplementary yieldable biasing means inoperative, wherein said further means comprise a bi-metallic element having one condition in which it is operable to render said counteracting means inoperative and another condition in which it allows operation of said counteracting means, a positive temperature coefficient element which is adapted to be subjected to an electrical output when the engine is running under its own power and which is located in heat conducting relationship with the bi-metallic element, and a radiator plate which is located in heat conducting relationship with the bi-metallic element and in heat conducting relationship with the positive temperature coefficient element whereby the bi-metallic element is charged from said one condition to said other condition by being heated by conduction of heat to it from the positive temperature coefficient element and by radiation of heat from the radiator plate which in turn is heated by conduction of heat to it from the positive temperature coefficient element.

8. An air/fuel induction system according to claim 7, wherein the positive temperature co-efficient element is sandwiched between one end of the bi-metallic element and an end of the radiator plate.

9. An air/fuel induction system for spark ignition internal combustion engines including a cold start system comprising an automatic choke valve carburetor which is arranged so that an air/fuel mixture rich in fuel is supplied to the engine through an inducation passage when the engine is started when it is cold, the mixture supplied being leaned off automatically as the engine warms up towards its normal running temperature at which there is no further need for fuel enrichment by operation of the cold start system, said carburetor comprising a choke valve, a first spring means, said choke valve being biased by said first spring means into a position in which said choke valve extends across said induction passage, a second spring means which augments the biasing load exerted by said first spring means to oppose opening movement of said choke valve due to the action of a depression established in said induction passage, means to remove the load of said second spring means from said choke valve at the end of a predetermined time interval after the engine begins to run under its own power, said means to remove the load of said second spring including a valve mechanism which is closed under cold start conditions and which opens at the end of a predetermined time interval after the engine begins to run under its own power, said valve mechanism comprising a bi-metallic element carrying a valve member, the element having one condition in which the valve member is seated and another condition in which the valve member is unseated, a positive temperature co-efficient element which is adapted to be subjected to an electrical output when the engine is running under its own power and which is located in heat conducting relationship with the bi-metallic element, and a radiator plate which is located in adjacent spaced relationship with the bi-metallic element and in heat conducting relationship with the positive temperature co-efficient element whereby the bi-metallic element is changed from said one condition to said another condition by being heated by conduction of heat to it from the positive temperature co-efficient element and by radiation of heat from the radiator plate which in turn is heated by conduction of heat to it from the positive temperature co-efficient element.

* * * * *